US006381294B1

(12) United States Patent
Britton

(10) Patent No.: US 6,381,294 B1
(45) Date of Patent: Apr. 30, 2002

(54) DISC SORTING APPARATUS AND METHOD

(75) Inventor: Martin Robert Britton, Bristol (GB)

(73) Assignee: Technical Casino Services Ltd. (GB)

( * ) Notice: Subject to any disclaimer, the term of this patent is extended or adjusted under 35 U.S.C. 154(b) by 0 days.

(21) Appl. No.: 09/600,796

(22) PCT Filed: Jan. 22, 1999

(86) PCT No.: PCT/GB99/00218

§ 371 Date: Jan. 16, 2001

§ 102(e) Date: Jan. 16, 2001

(87) PCT Pub. No.: WO99/38126

PCT Pub. Date: Jul. 29, 1999

(30) Foreign Application Priority Data

Jan. 23, 1998 (GB) ..... 9801542

(51) Int. Cl.[7] ..... G06M 7/00; G06M 9/00; G06M 11/00

(52) U.S. Cl. ..... 377/7; 377/6; 209/552

(58) Field of Search ..... 377/6, 7; 209/264, 209/244, 247, 560–565, 552

(56) References Cited

U.S. PATENT DOCUMENTS 5,530,730 A * 6/1996 Takemoto et al. ..... 377/7
5,757,876 A * 5/1998 Dam et al. ..... 377/7

FOREIGN PATENT DOCUMENTS

| | | |
|---|---|---|
| FR | 2393732 | 12/1978 |
| GB | 0266021 | 4/1988 |
| WO | WO 9620460 | 7/1996 |
| WO | WO 9623281 | 8/1996 |
| WO | WO 9630877 | 10/1996 |

OTHER PUBLICATIONS

Patent Specification for GB 1,571,219 *Devices for Sorting Members in the Form of Discs*, Jul. 9, 1980.

* cited by examiner

*Primary Examiner*—Tuan T. Lam
(74) *Attorney, Agent, or Firm*—Baker Botts LLP

(57) ABSTRACT

A disc sorting apparatus and method is provided for sorting discs of different identities. When discs are received they are conveyed to a sorting arrangement for sorting the discs into respective stacks determined by their identities. The speed of conveyance and thus sorting of the discs is determined by the detected number of discs being identified.

17 Claims, 6 Drawing Sheets

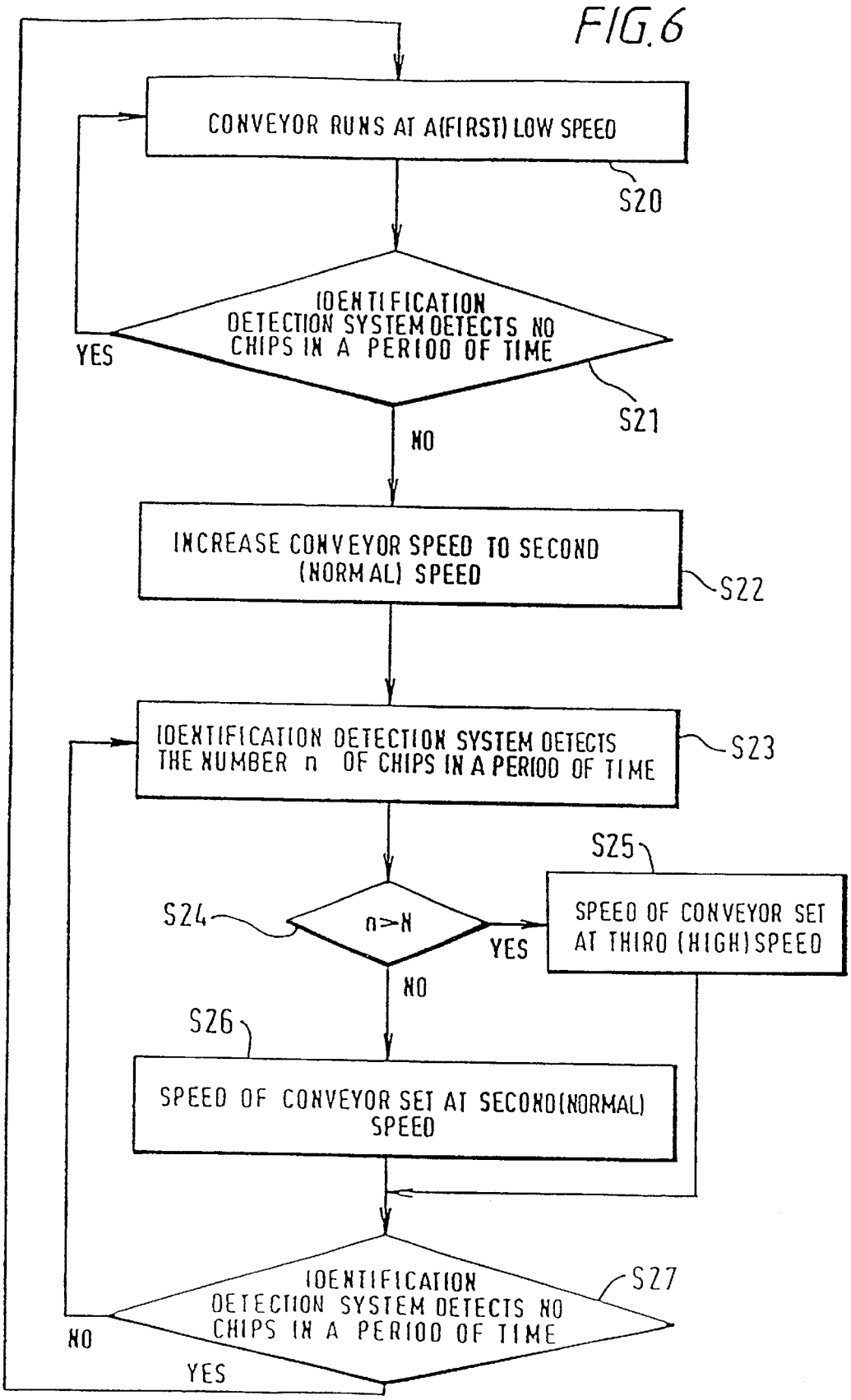
FIG. 6
CONVEYOR RUNS AT A(FIRST) LOW SPEED
S20
IDENTIFICATION DETECTION SYSTEM DETECTS NO CHIPS IN A PERIOD OF TIME
YES
S21
NO
INCREASE CONVEYOR SPEED TO SECOND (NORMAL) SPEED
S22
IDENTIFICATION DETECTION SYSTEM DETECTS THE NUMBER n OF CHIPS IN A PERIOD OF TIME
S23
S25
S24
n>N
YES
SPEED OF CONVEYOR SET AT THIRD (HIGH) SPEED
NO
S26
SPEED OF CONVEYOR SET AT SECOND (NORMAL) SPEED
IDENTIFICATION DETECTION SYSTEM DETECTS NO CHIPS IN A PERIOD OF TIME
S27
NO
YES

DISC SORTING APPARATUS AND METHOD

The present invention generally relates to a method and apparatus for sorting discs of different identities.

Devices for sorting discs of different identities exist in many different forms and may be used for sorting discs of widely differing kinds. A common field of application is coin sorting. In this field of application the discs are constituted by coins and their identities are represented by the denominations of the coins and may be ascertained by detecting the dimensions, shape, weight, electrical properties or some other characteristic of the coins by which the denominations differ from one another. There are also fields of application other than coin sorting, such as sorting of tokens, labelling discs, electrical and optical filter discs, coin calls, and so on. Another field of application is sorting of gaming counters and the like.

One method of identifying and sorting discs is disclosed in GB-A-2254419. In this arrangement discs are received in a hopper and transferred from the hopper to a sorting arrangement by a rotating disc.

Another chip sorting apparatus is disclosed in GB-A-1571219 and GB-A-1571220. In such an arrangement discs are received in a hopper and conveyed from the hopper to a chip sorting arrangement using an endless conveyor.

In these prior art methods, no account is taken of the possible variable nature in the sorting requirement for the apparatus. For instance, discs to be sorted can be received in batches with large intervals therebetween. This is particularly so when the apparatus is used for sorting gaming chips in conjunction with the game of roulette where there is a several minute interval between each game and at the end of each game a large number of chips need to be sorted.

WO 96/20460 discloses a medal counting apparatus in which medals are received in a hopper and transferred by a conveying means to a counting station. The speed of the conveying means is controlled in dependence upon whether medals are detected entering the hopper. In this arrangement a sensor is placed in the hopper and the conveying means is stopped and started in dependence upon detected medals.

It is an object of the present invention to provide a simpler and more reliable disc sorting apparatus.

In accordance with an aspect of the present invention there is provided a disc sorting apparatus for sorting discs of different identities, the apparatus comprising:

receiving means for receiving discs to be sorted;

holding means for holding a plurality of groups of discs;

conveying means for conveying the received discs from said receiving means to said holding means;

sorting means including disc identifying means for detecting and identifying discs conveyed by said conveying means, and transfer means for transferring the conveyed and identified discs to said holding means and for putting discs of the same identity in the same group; and control means responsive to said disc identifying means to cause said conveying means to run at a low speed when said disc identifying means detects no discs in a period of time, or at a higher speed if discs are detected.

Also in accordance with another aspect of the present invention there is provided a disc sorting method for sorting discs of different identities, the method comprising the steps of:

receiving discs to be sorted at receiving means;

conveying the received discs from the receiving means to holding means for holding groups of discs using conveying means;

detecting and identifying discs conveyed by said conveying means; and transferring the conveyed discs from said conveying means to said holding means so as to put discs of the same identity in the same group;

wherein when no discs are detected by the detecting and identifying step in a period of time, said conveying means is controlled to convey at a low speed, otherwise said conveying means is controlled to convey discs at a higher speed.

Thus in accordance with the present invention no additional detection means is required for detecting the reception of discs. Instead the disc identifying means performs not only the identifying function of determining the identification of the discs, but also the detection and counting of the discs. The conveying means is controlled to run at a low speed when the disc identifying means detects no discs in a period of time and at a higher speed if discs are detected by the disc identifying means. In this way the additional costs and complexity of an additional detection system is avoided and the conveying means can be continuously operated at a low speed in order to bring any received discs to the disc identifying means for identification and counting. Further, the constant stopping and starting which causes increased wear and tear in the arrangement of WO 96/20460 is avoided.

The present invention overcomes the deficiencies in the prior art in that it is able to reduce machine wear by matching the conveying speed to the sorting demand of the apparatus. For example, the low conveying speed is used as an idling speed when there are no discs to be sorted, a medium speed can be used for sorting discs at a "normal" level and a high conveying speed can be used when there is a high sorting demand i.e. a large number of discs have been received in the receiving means and are awaiting sorting.

In an embodiment of the present invention the disc identifying means is arranged to detect and identify the discs as they are being conveyed by the conveying means just prior to being transferred to the appropriate stacks in the holding means i.e. sorted.

The conveying means preferably conveys the discs serially thus allowing the discs to be identified serially.

In an embodiment the conveying means comprises an endless conveyor. The present invention is not however limited to such a conveying means and any form of conveying means can be used such as a rotating arm or disc.

In an embodiment the receiving means comprises a hopper arranged adjacent to the conveying means to allow for a large number of discs to be received in the hopper, collected and conveyed by the conveyor means to the holding means.

In an embodiment the holding means is arranged to hold the discs as a plurality of stacks and the transfer means is adapted to stack the discs of the same identity in the same stack. In this way the sorted discs are presented as a plurality of stacks.

In an embodiment the holding means is arranged adjacent to the conveying means in the form of an endless conveyor and the transfer means provides for the transfer of the discs to the bottom of the stacks. This allows the user to remove sorted discs from the top of the stacks.

The disc identifying means can comprise any means of identifying the discs and the technique applied will depend upon the form of the discs and the differences between the discs defining their identities. For example, for coins, the detection system can comprise an electromagnetic system for detecting the electromagnetic properties of the coins. For gaming chips, the detection system can comprise an optical detection system for detecting the colour of at least a part of the disc since discs of different identities have different colours.

The control means of the present invention can comprise a suitably programmed computer. Thus the present invention can be embodied as any suitable storage medium for storing computer readable code for controlling a computer to carry out the control. The storage means can comprise any conventional storage medium such as a magnetic disc, optical disc, or electronic circuit e.g. read only memory (ROM). The present invention can also comprise a signal carrying the computer program e.g. when the program is downloaded over a network.

Embodiments of the present invention will now be described with reference to the accompanying drawings in which:

FIG. 6 is a flow diagram illustrating the steps of the method of controlling the conveyor speed in accordance with an embodiment of the present invention.

An embodiment of the present invention will now be described with reference to sorting gaming chips. The present invention is not however limited to the sorting of such chips and is applicable to the sorting of any disc shaped objects which have different properties which can be identified to enable sorting thereof.

The embodiment of the present invention comprises an improvement to the CHIPPER CHAMP (Trade Mark) chip sorting apparatus which is the subject of published patent numbers GB-A-1571219 and GB-A-1571220 the contents of which are hereby incorporated by reference. The construction of the chip sorting apparatus is substantially the same as that described in the abovenoted patents. The significant differences are in the control of the speed of operation of the apparatus and thus only a brief description will be given hereinafter of the construction of the apparatus.

Figure 1:
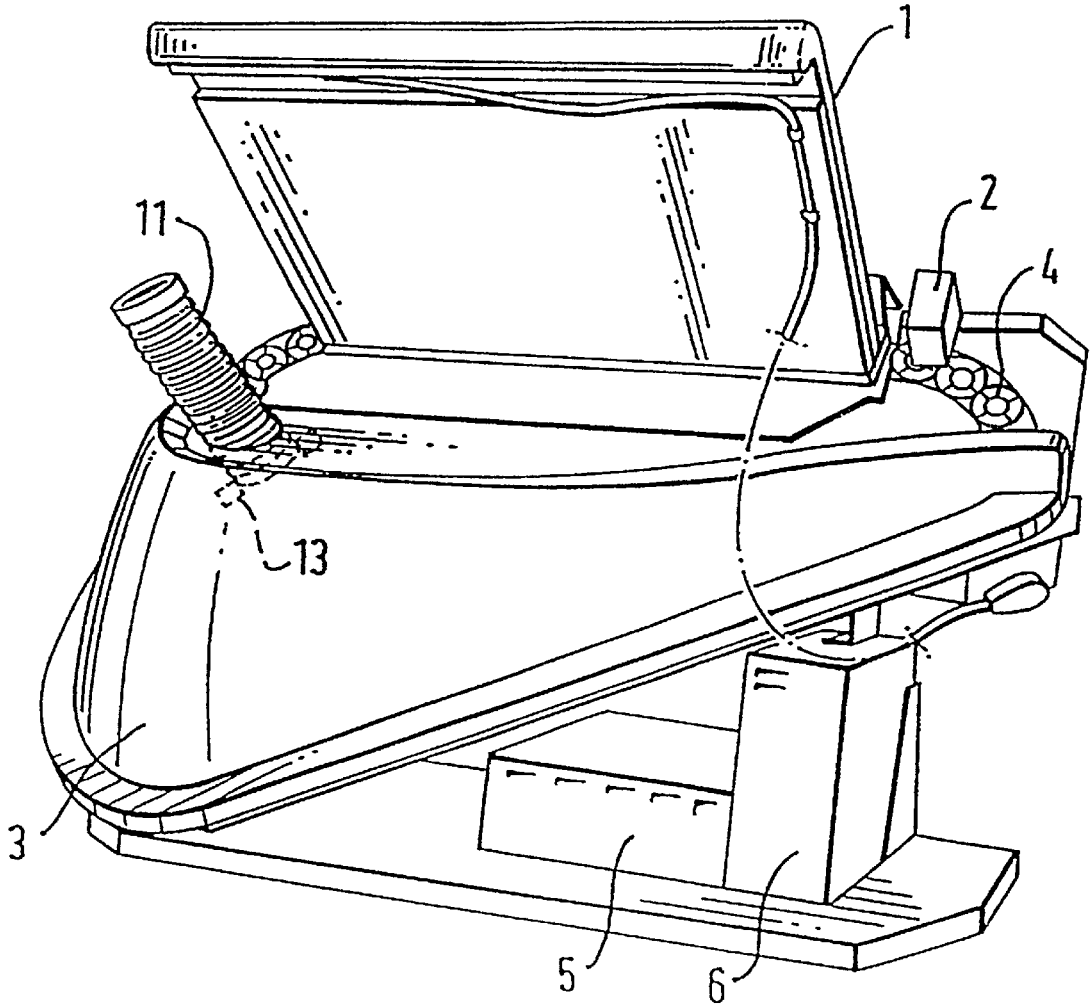
FIG. 1 is a front perspective view of a gaming chip sorting apparatus in accordance with an embodiment of the present invention.
Figure 2:
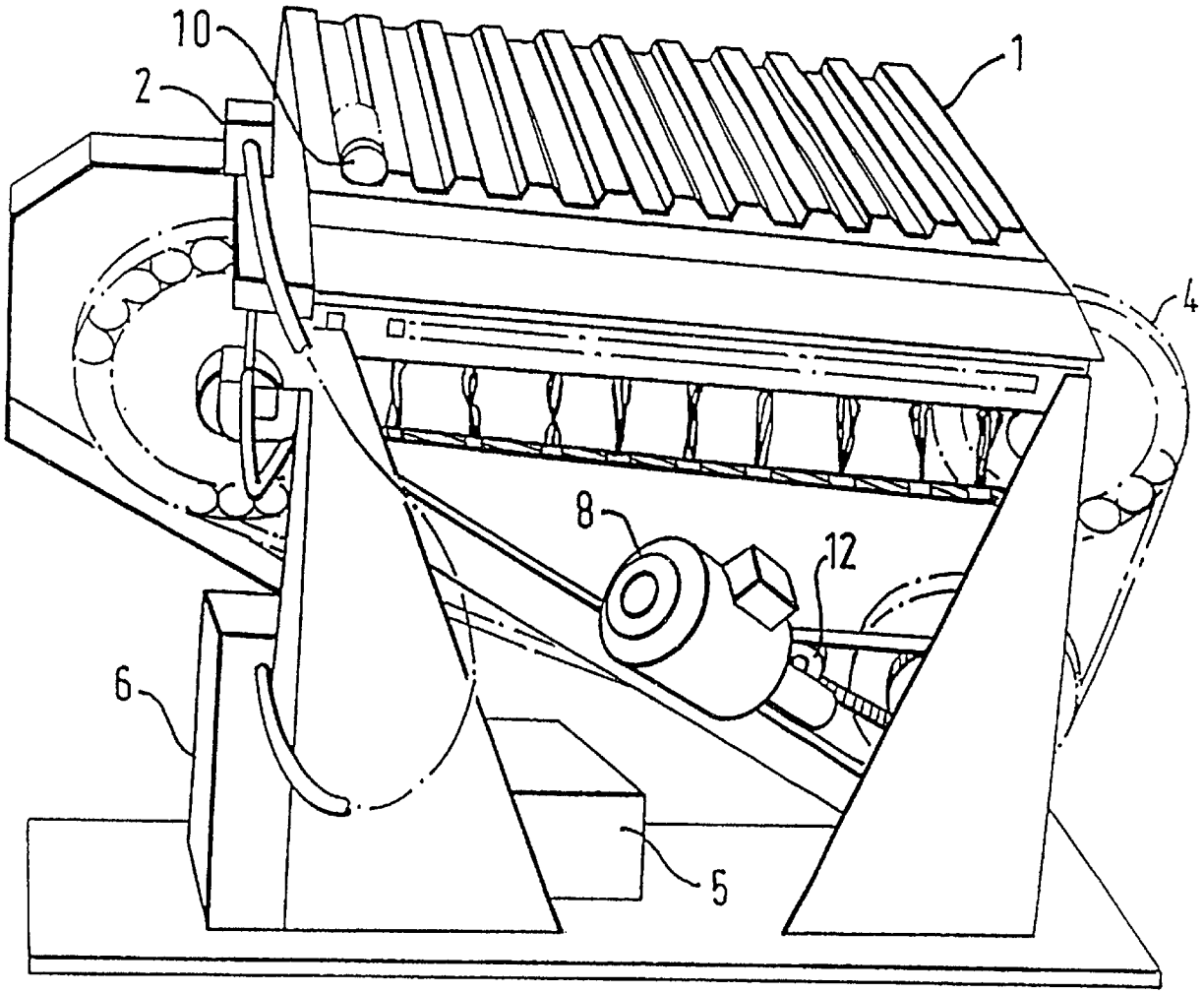
FIG. 2 is a reverse perspective view of the gaming chip sorting apparatus of FIG. 1.

FIGS. 1 and 2 are perspective views of the chip sorting apparatus wherein a hopper 3 is provided for receiving the chips to be sorted via a hopper funnel 11. The hopper funnel 11 comprises a flexible rubber conduit which can be attached to a roulette table allowing a croupier to empty chips thereinto whereupon they will fall into the hopper 3. Partially within the hopper 3 there is provided an endless conveyor 4. Above the hopper 3 there is provided a rack 1 for receiving sorted chips 10 in stacks. Also above the hopper 3 there is provided a scanner 2 for optically detecting the colour of chips passing thereunder on the conveyor 4. Underneath the hopper 3 there is provided a computer 5 for controlling the apparatus and a power supply 6. The conveyor 4 is driven by a motor 8 via a gear and clutch arrangement 12.

When chips are loaded into the hopper 3, they fall into recesses in the conveyor 4 and the conveyor 4 lifts them upwards towards the scanner 2 whereupon they can be identified. In this embodiment the scanner 2 comprises an optical detector arrangement for detecting the colour of the chips as described in the abovenoted patents or as described in UK Patent Application number: 9810771.7 the content of which is hereby incorporated by reference. Chips of different value i.e. different identities, have different colours and this can be detected by the scanner 2 and the appropriate colour signal passed on to the computer 5. The chips then pass in the conveyor 4 between the base of the stacks of chips 10 in the rack 1 and a linear array of solenoids to transfer the appropriate chips into the appropriate stacks 10.

Figure 3:
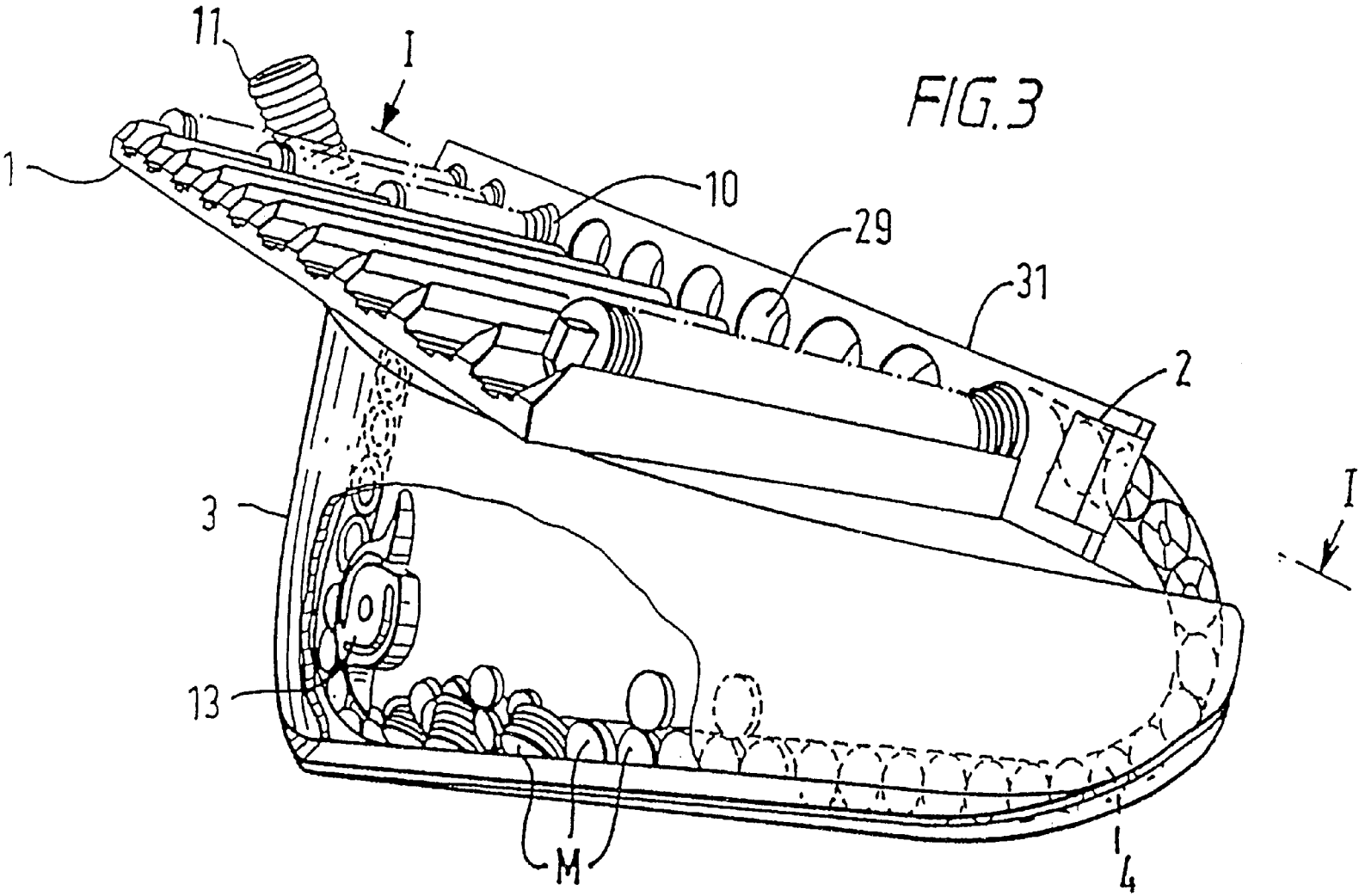
FIG. 3 is a partial cut away diagram showing the operation of the gaming chip sorting apparatus.

FIG. 3 shows in more detail the conveyance of chips M to the stacks. The hopper 3 has an inclined lower surface along which runs the conveyor 4. The conveyor 4 has recesses for receiving the chips M and any chips which are not within the recesses in the conveyor 4 fall under gravity towards the bottom of the hopper 3. Within the bottom of the hopper 3 there is provided a paddle arrangement 13 for agitating the chips in order to avoid the chips jamming.

Chips are thus conveyed along the conveyor 4 past the scanner 2 and along past the bases of the stacks 10 of chips in the rack 1. The scanner 2 identifies the chips by their colour and the computer receives the colour signals from the scanner 2 in order to control the solenoids in order to eject the chips into the correct stacks.

Figure 4:
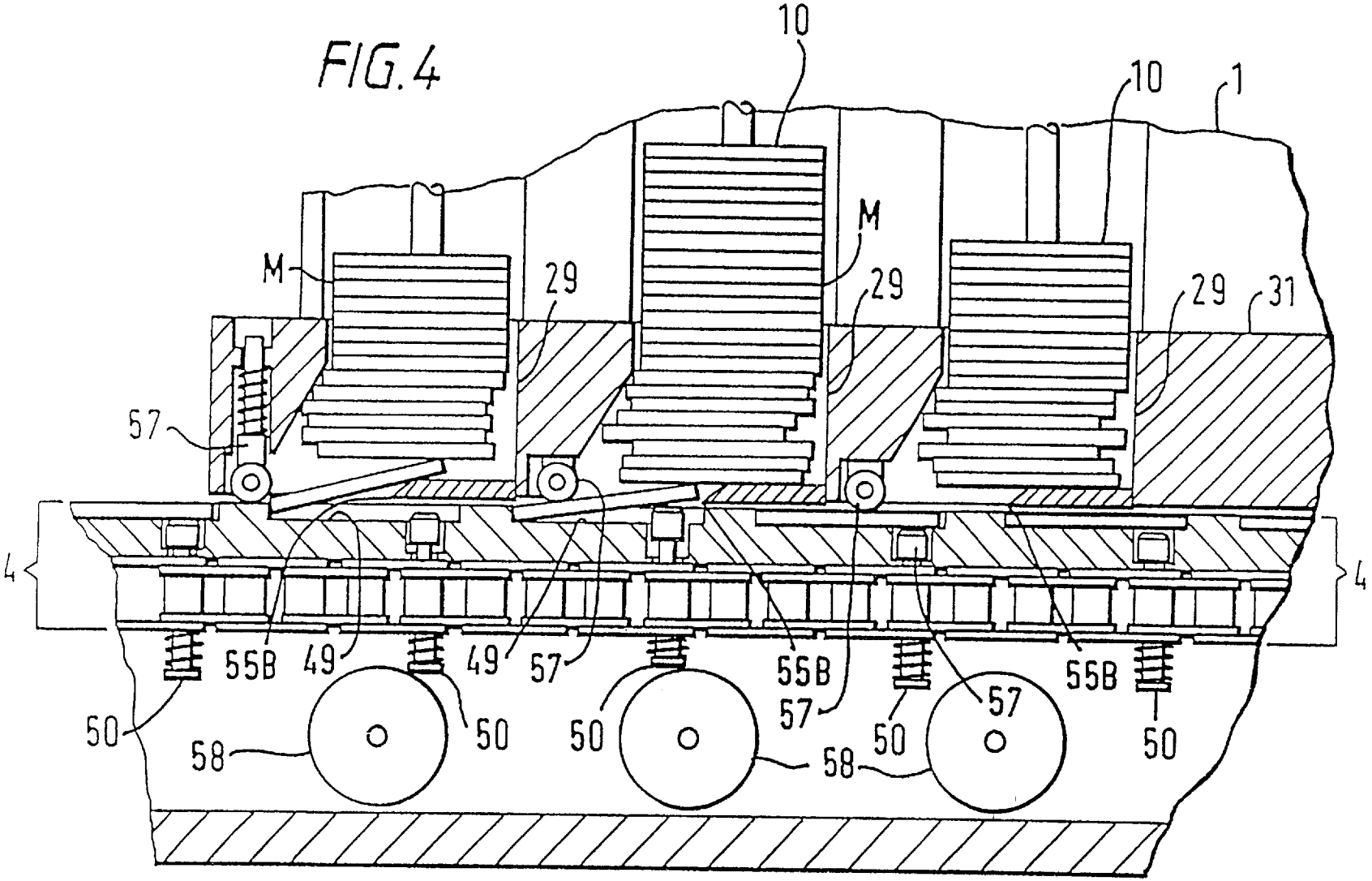
FIG. 4 is a part section on line I—I of FIG. 3.

FIG. 4 shows the process of transferring or ejecting the chips from the conveyor 4 into the base of the stacks 10 in more detail. In FIG. 4 the conveyor 4 moves from left to right and within the conveyor 4 chips M are arranged in recesses 49. The conveyor 4 has pins 50 arranged therein underneath the leading edges of the recesses 49. When the cams 58 are selectively brought into engagement with the pins 50 the pins 50 are urged upwards thereby lifting the leading edge of the chips. The leading edge of the chips then come into contact with the edge **55*b* at the bottom of the stacks 10. The edge 55*b* is chamfered in order to cause the chips to be forced onto the bottom of the stack 10 by the driving force of the conveyor 4. A member 57 is provided to hold down the trailing edge of the chip as the pin 50 lifts up the leading edge. Thus, the chip is driven onto the bottom of the stack 10 extending through a hole 29 in the bar 31 forming the base of the rack 1**.

The cams 58 are moved by solenoids which are selectively activated in accordance with the identification made by the scanner 2. In this way as the belt 4 moves along, chips M which have been previously identified can be transferred from the conveyor 4 to the respective stack 10 by the selective operation of a solenoid. This sorting operation is carried out under the control of the computer 5.

A method of controlling the conveying and sorting speed of the apparatus described hereinabove will now be described hereinafter with reference to FIGS. 5, and 6.

In this embodiment of the present invention the chip identification system is used not only to identify the chips but also to detect and count the chips in order to control the conveying speed. Thus, in this embodiment there is no need for a second detection system in order to detect chips received into the hopper 3. This provides a far less complex system then in the prior art.

Figure 5:
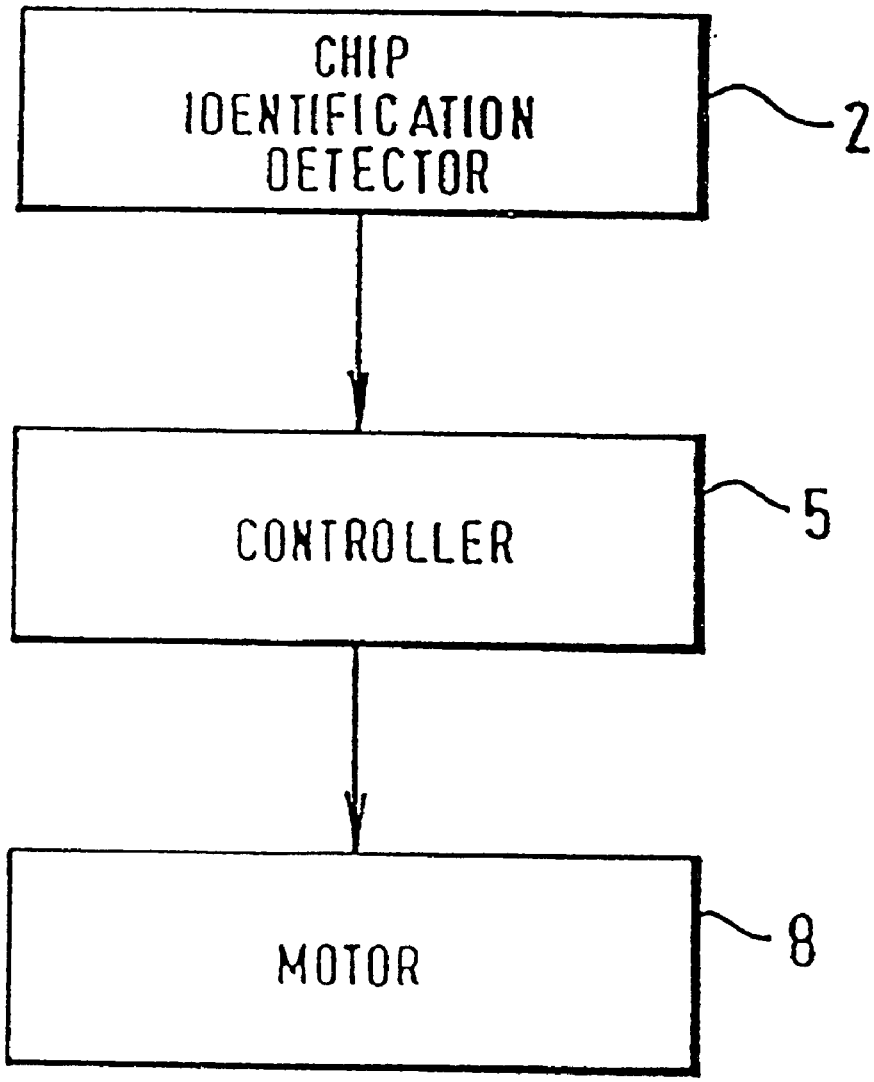
FIG. 5 is a schematic diagram of a control system of an embodiment of the present invention.

FIG. 5 illustrates schematically the control system wherein the chip identification detector 2 detects the presence of chips and the presence of each chip is passed on to the controller 5 in order to enable the controller 5 to control the speed of the motor 8.

FIG. 6 is a flow diagram illustrating the steps of controlling the conveying speed in accordance with this embodiment of the present invention. In step S20 the conveyor 4 runs at a first (low) speed. This is the default speed set for continuous operation even when there are no chips to be sorted. The process then proceeds to step S21. If in step S21 it is determined that the identification detection system (the scanner 2) detects no chips, the conveyor 4 continues to run at the first speed and the process returns to step S20. If however a chip is detected in step S21 the process proceeds to step S22 whereupon the conveyor speed is increased to a second (normal) speed. In step S23 the identification detection system then detects the number n of chips in a period of time. In step S24 the process then determines whether the number n of chips detected is greater than a predetermined number N and if so the speed of the conveyor is set at a third (high) speed in step S25. Otherwise in step S26 the speed of the conveyor is set or kept at the second (normal) speed. In step S27 the process then determines whether the identification detection system detects no chips in a period of time. If chips are not detected the process returns to step S20 whereupon the conveyor is set to run at a first (low) speed. Otherwise the process returns to step S23 to allow the continued detection of the number n of chips.

In the chip sorting apparatus illustrated in FIGS. 1 to 4, the conveyor 4 has 46 recesses 49 for receiving chips. As an example the three speeds which can be used in this third embodiment are a low or economy speed of 3.5 rpm, a normal speed of 7 rpm and a high speed of 12 rpm. Thus the normal chip sorting rate is 322 chips per minute and when it is detected that the conveyor 4 is full, indicating that there are a large number of chips waiting in the hopper to be sorted, the speed of the conveyor 4 can be increased to the high speed thereby sorting chips at a higher rate of 552 chips per minute.

In order to avoid the motor continuously switching between normal and fast speeds, once a speed change has occurred, the controller can allow the conveyor to operate at that speed for a predetermined period before changing it again.

The period of time over which the number of chips can be counted in order to determine n can be any period e.g. 1 minute 45 seconds. Thus if a threshold N is set at 400 chips detected within this period, the high speed conveying can be switched on for a minimum period of say two minutes. The normal output speed can then be resumed when less than 400 chips are detected within a 1 minute 45 second period.

Instead of actually counting chips for a predetermined period. of time, in step S23 the number of chips detected can be counted and the number of empty cups passing the detector also counted. Instead of there being a single number there is thus a ratio. If in step S24 there are less than 20 empty cups i.e. more than 80 chips in 100 cups the higher speed of the conveyor is set in step S25. In step S27 the detection of no chips for a period of time can take the form of detecting 20 consecutive empty cups on the conveyor. Since the conveyor speed is known, counting chips in 100 cups in step S23 and detecting 20 consecutive empty cups in step S27 is equivalent to detection for a period of time.

Although the present invention has been described hereinabove by reference to a specific embodiment, the present invention is not limited to the specific embodiments and it will be apparent to a skilled person in the art that modifications are possible within the spirit and scope of the present invention.

What is claimed is:

1. A disc sorting apparatus for sorting discs of different identities, the apparatus comprising:

receiving means for receiving discs to be sorted;

holding means for holding a plurality of groups of discs;

conveying means for conveying the received discs from said receiving means to said holding means;

sorting means including disc identifying means for detecting and identifying discs conveyed by said conveying means, and transfer means for transferring the conveyed and identified discs to said holding means and for putting discs of the same identity in the same group; and control means responsive to said disc identifying means to cause said conveying means to run at a low speed when said disc identifying means detects no discs in a period of time, or at a higher speed if discs are detected.

2. A disc sorting apparatus according to claim 1, wherein said control means causes said conveying means to run at one or more higher speeds dependent upon the number of discs detected by said disc identifying means in a period of time.

3. A disc sorting apparatus according to claim 1, wherein said conveying means is arranged to convey the discs serially.

4. A disc sorting apparatus according to claim 1, wherein said conveying means comprises an endless conveyor.

5. A disc sorting apparatus according to claim 4, wherein said receiving means comprises a hopper arranged adjacent to said endless conveyor and having an opening for receiving the discs.

6. A disc sorting apparatus according to claim 4, wherein said holding means holds the discs as a plurality of stacks and said transfer means stacks discs of the same identity in the same stack in said holding means.

7. A disc sorting apparatus according to claim 6, wherein said holding means is arranged to hold said stacks in a row adjacent said endless conveyor.

8. A disc sorting apparatus according to claim 6, wherein said transfer means transfers discs to the bottom of the stacks in said holding means.

9. A disc sorting apparatus according to claim 1, wherein said disc identifying means comprises an optical detection system for detecting the colour of at least a portion of the discs, wherein discs of different identities have different colours.

10. A disc sorting method for sorting discs of different identities, the method comprising the steps of:

receiving discs to be sorted at receiving means;

conveying the received discs from the receiving means to holding means for holding groups of discs using conveying means;

detecting and identifying discs conveyed by said conveying means; and transferring the conveyed discs from said conveying means to said holding means so as to put discs of the same identity in the same group;

wherein when no discs are detected by the detecting and identifying step in a period of time, said conveying means is controlled to convey at a low speed, otherwise said conveying means is controlled to convey discs at a higher speed.

11. A disc sorting method according to claim 10, wherein said conveying means is controlled to convey discs at one or more higher speeds dependent upon the number of discs detected by the detecting and identifying step in a period of time.

12. A disc sorting method according to claim 10 or, wherein the discs are conveyed serially.

13. A disc-sorting method according to claim 10, wherein said holding means holds the groups of discs as stacks, and the transferring step puts discs of the same identity into the same stack.

14. A disc sorting method according to claim 13, wherein the transferring step puts the discs at the bottom of the stacks.

15. A disc sorting method according to claim 10, wherein the detecting and identifying step comprises detecting the colour of at least a portion of the discs, wherein discs of different identities have different colours.

16. A storage medium storing computer readable code for instructing a processor to operate as said control means in accordance with claim 1.

17. A signal carrying computer readable code for instructing a processor to operate as said control means in accordance with claim 1.

* * * * *